United States Patent [19]

Mattick

[11] Patent Number: 4,876,829

[45] Date of Patent: Oct. 31, 1989

[54] INFLATABLE TENT STRUCTURE

[75] Inventor: Michael J. Mattick, Charlotte, N.C.

[73] Assignee: Pneumo-Beam International Ltd., Charlotte, N.C.

[21] Appl. No.: 145,051

[22] Filed: Jan. 19, 1988

[51] Int. Cl.[4] ..... E04B 1/34

[52] U.S. Cl. ..... 52/2; 135/1

[58] Field of Search ..... 52/2 J; 135/100, 102, 135/104, 119, DIG. 9

[56] References Cited

U.S. PATENT DOCUMENTS

| | | | |
|---|---|---|---|
| 2,946,337 | 7/1960 | Wolshin | 135/1 |
| 2,955,606 | 10/1960 | Walker | 135/1 |
| 3,899,853 | 8/1975 | Wertman | 52/2 |
| 3,999,333 | 12/1976 | Amarantos | 52/2 J |
| 4,269,210 | 5/1981 | Marks | 135/104 |
| 4,408,260 | 10/1983 | Miedel | 135/119 X |

*Primary Examiner*—David A. Scherbel
*Assistant Examiner*—Creighton Smith
*Attorney, Agent, or Firm*—W. Thad Adams, III

[57] ABSTRACT

An inflatable tent structure comprising a plurality of pneumatically interconnected, elongate inflatable tubes defining the perimeter of the tent structure for being inflated in unison. A valve is provided for inflating the tubes and a plurality of wall panels are suspended from and between the tubes to define the enclosure of the tent whereby the tubes define a support structure exterior to the enclosure of the tent. The tubes define a dome-shaped structure, the tubes converging in pneumatic interconnection with each other in a single plane at the apex of the dome-shaped structure. The valve includes a manifold into which all of the tubes interconnect at the apex of the dome-shaped structure.

8 Claims, 2 Drawing Sheets

INFLATABLE TENT STRUCTURE

TECHNICAL FIELD AND BACKGROUND OF THE INVENTION

This invention relates to an inflatable tent structure, the design of which permits the tent to be easily erected, collapsed and stored. The design of the tent also permits the structure to be easily manufactured with a minimum of parts and fabrication. Nevertheless, the structure is sturdy, weather resistent and provides safe and comfortable shelter.

The tent is characterized by the placement of the supporting perimeter of the tent structure completely exterior to the interior of the tent. This provides easy access to the inflated structure for ease of repair and more uninterrupted space for the occupants.

SUMMARY OF THE INVENTION

Therefore, it is an object of the invention to provide an inflatable tent structure which is inexpensive to manufacture and maintain.

It is another object of the invention to provide an inflatable tent structure which is easy to erect, collapse and store.

It is another object of the invention to provide an inflatable tent structure which can be inflated with a simple low pressure air pump.

It is another object of the invention to provide an inflatable tent structure which provides inexpensive shelter on a temporary or emergency basis on short notice.

It is still another object of the invention to provide an inflatable tent structure which has no sharp or rigid components so the tent can be dropped from an aircraft or helicopter to the ground in rescue and disaster situations.

These and other objects of the present invention are achieved in the preferred embodiments disclosed below by providing an inflatable tent structure comprising a plurality of pneumatically interconnected, elongate inflatable tubes defining the perimeter of the tent structure for being inflated in unison.

Valve means are provided for inflating the tubes and a plurality of wall panels are suspended from and between the tubes to define the enclosure of the tent whereby the tubes define a support structure exterior to the enclosure of the tent.

According to one preferred embodiment of the invention, the tubes define a dome-shaped structure, the tubes converging in pneumatic interconnection with each other in a single plane at the apex of the dome-shaped structure.

According to another preferred embodiment of the invention, the valve means includes a manifold into which all of the tubes interconnect at the apex of the dome-shaped structure.

Preferably, the valve means comprises a valve for interconnection with an air pump and the tubes include an interiorly projecting flange to which the wall panels are attached in spaced-apart relation.

Preferably, the flange is integrally formed from material from which the tubes are formed by joining adjacent material together along a predetermined length and width thereof.

According to another preferred embodiment of the invention, the tubes define a saw horse-like structure with two pairs of downwardly diverging legs interconnected by a single top support for defining a tent which is substantially triangular in cross-section.

Preferably, the invention includes a manifold into which respective pairs of the legs interconnect and an air inlet valve for interconnection with an air pump.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
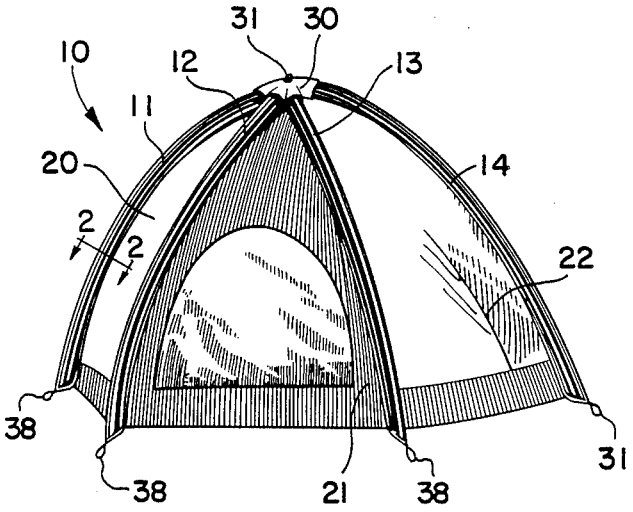
FIG. 1 is a perspective view of one embodiment of the invention according to the present invention.

Referring now specifically to the drawings, a tent according to the present invention is illustrated in FIG. 1 and shown generally at reference numeral 10. The tent 10 is constructed of six interconnected tubes 11–16, inclusive, four of which are shown in FIG. 1 and all six in FIG. 3. These tubes collectively define a dome-shaped support structure from which six wall panels 20–25 are suspended. See FIGS. 1 and 3. Wall panels 20–25 are constructed of a breathable fabric material selected according to the anticipated climate within which the tent 10 will likely be used. As is also shown in FIG. 1, a suitable window and door are provided.

Tubes 11–16 are fabricated from a rubberized fabric or a thermoplastic sheet material having a wall structure of sufficient density to resist passage of air under pressure.

Figure 3:
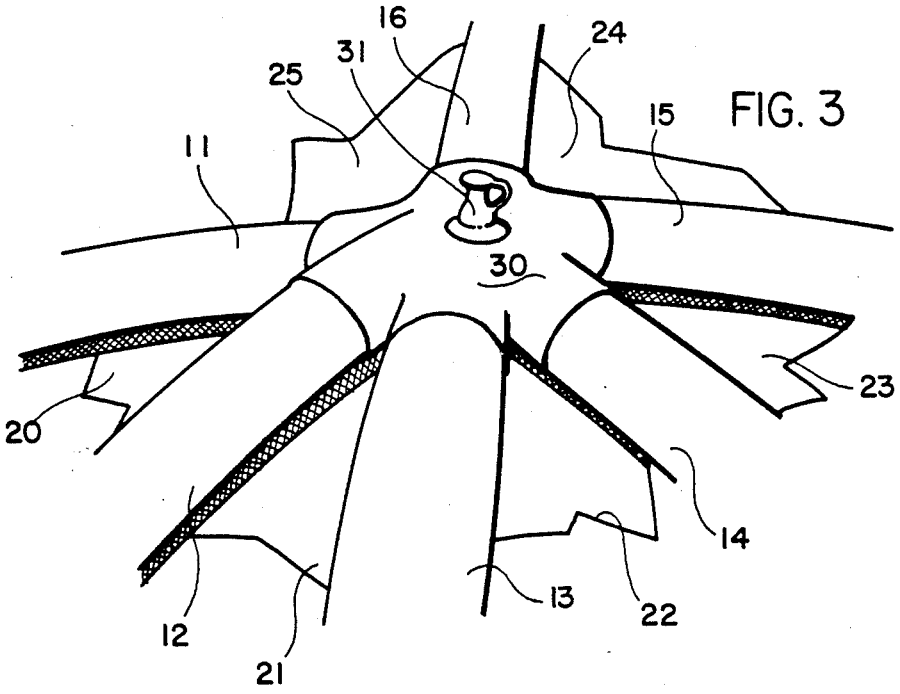
FIG. 3 is a fragmentary, enlarged view of the inflation manifold of the tent shown in FIG. 1.

Tubes 11–16 are interconnected by means of an inflation manifold 30 positioned at the apex of the dome-shaped structure, as is best shown in FIG. 3. Each of the tubes 11–16 interconnect with one of the legs of manifold 30. A standard air valve 31 permits connection with a source of air, such as a small air compressor of the type operated off of a car battery or a foot operated manual pump.

Figure 2:
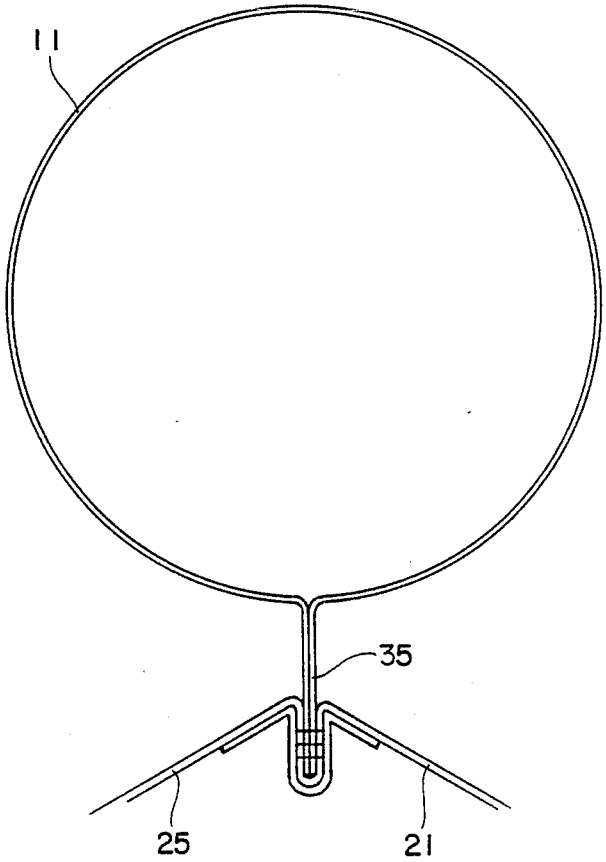
FIG. 2 is a cross-sectional view of one of the tubes from which the tent structure is constructed and the adjoining wall panels.

Wall panels 20–25 are suspended beneath and between tubes 11–15 by means of flanges 35 formed on the bottom of each of the tubes 11–15. As is best shown in FIG. 2, flange 35 is formed by adhering together adjacent material of the tube 11 and heat welding or cementing the adjacent walls together along both the length and width of the flange 36. Tube 11 and the adjacent wall panels are connected together by stitching the adjacent edges of the flange 35 and the wall panels 25 and 21 together. Thereafter, the entire stitched structure may be overtaped to further secure the seam and to provide a neater looking joint.

A floor, including an air mattress (not shown) may be incorporated into the structure of the tent 10 and may be integrated into the structure so that the mattress inflates along with the tubes 11–15, or so that it is separately inflatable. The tent 10 can be secured to the ground with pegs or spikes attached to a loop 38 on the bottom of each of the tubes 11–15.

Figure 4:
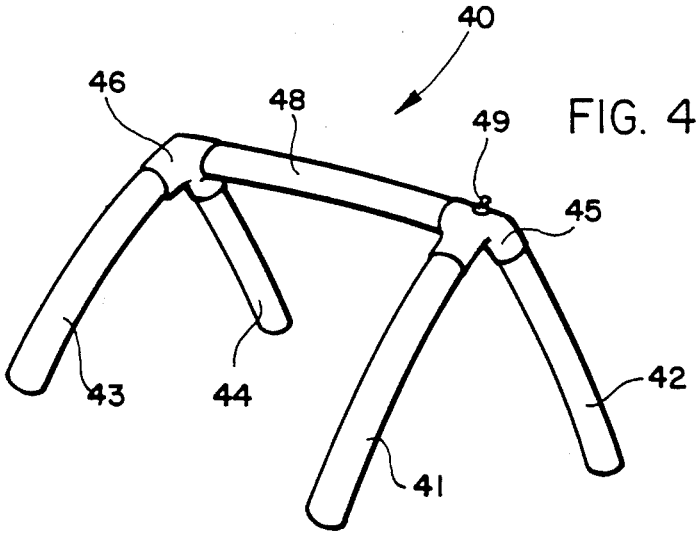
FIG. 4 is a perspective view of an alternate shape of the tent structure.

The structure described above can be fabricated in many different shapes and sizes. Another shape is shown in FIG. 4, and comprises a saw horse-shaped tent 40 in which two pairs of downwardly diverging legs 41, 42 and 43, 44 are interconnected at their converging top ends by manifolds 45, 46, respectively. A top support 48 interconnects the manifolds 45, 46 whereby inflation of the entire structure can be accomplished by introducing pressurized air through a single air valve 49 in manifold 45. Wall panels (not shown) are attached to tent 40 in the manner described above for tent 10.

Ordinarily, about 4 pounds per square inch of air is sufficient to properly inflate the tent 10. This permits the inflation to be carried out manually by means of a foot operated or similar type of pump.

I claim:

1. An inflatable tent structure comprising:

(a) a plurality of pneumatically interconnected, elongate inflatable tubes positioned in spaced-apart relation around the perimeter of the tent structure for being inflated in unison, said tubes defining a dome-shaped structure terminating at an apex, said tubes converging in pneumatic interconnection with each other in a single plane at the apex of the dome-shaped structure;

(b) valve means for inflating the tubes and comprising a manifold into which all of the tubes interconnect at the apex of the dome-shaped structure; and (c) a plurality of wall panels suspended from and between adjacent tubes to define an enclosure of the tent whereby the tubes define a support structure exterior to the enclosure of the tent; wherein said tubes include an interiorly projecting flange to which said wall panels are attached in spaced-apart relation.

2. An inflatable tent structure comprising:

(a) a plurality of elongate inflatable tubes positioned in spaced-apart relation around the perimeter of the tent structure for being inflated, said tubes defining a dome-shaped structure terminating at an apex, said tubes converging in a single plane at the apex of the dome-shaped structure;

(b) valve means for inflating the tubes;

(c) a plurality of wall panels suspended from and between adjacent tubes to define an enclosure of the tent whereby the tubes define a support structure exterior to the enclosure of the tent; wherein said tubes include an interiorly projecting flange to which said wall panels are attached in spaced-apart relation.

3. An inflatable tent structure according to claim 1 or 2, wherein said flange is integrally formed from material from which the tubes are formed by joining adjacent material together along a predetermined length and width thereof.

4. An inflatable tent structure according to claim 1 or 2, wherein said tubes define a saw horse-like structure with two pairs of downwardly diverging legs interconnected by a single top support for defining a tent which is substantially triangular in cross-section.

5. An inflatable tent structure according to claim 4, wherein said valve means includes a manifold into which respective pairs of the legs interconnect.

6. An inflatable tent structure according to claim 5, wherein said valve means comprises a valve for interconnection with an air pump.

7. An inflatable tent structure according to claim 4, wherein aid tubes include an interiorly projecting flange to which said wall panels are attached in spaced-apart relation.

8. An inflatable tent structure according to claim 7, wherein said flange is integrally formed from material from which the tubes are formed by joining adjacent material together along a predetermined length and width thereof.

* * * * *